US007463839B2

(12) United States Patent
Yamaoka et al.

(10) Patent No.: US 7,463,839 B2
(45) Date of Patent: Dec. 9, 2008

(54) IMAGE FORMING APPARATUS INCLUDING A TONER WASTE CONTAINER NEAR-END CONDITION DETECTION FEATURE AND A FULL CONDITION JUDGMENT FEATURE

(75) Inventors: Takahiko Yamaoka, Kashiwa (JP); Eiichi Motoyama, Tokyo (JP); Yoshihito Osari, Tokyo (JP); Kuniyasu Kimura, Toride (JP); Hiroaki Tomiyasu, Toride (JP); Yuichi Yamamoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/087,515

(22) Filed: Mar. 24, 2005

(65) Prior Publication Data

US 2005/0220465 A1 Oct. 6, 2005

(30) Foreign Application Priority Data

Mar. 30, 2004 (JP) ..... 2004-098623

(51) Int. Cl.
*G03G 21/12* (2006.01)

(52) U.S. Cl. ..... 399/35

(58) Field of Classification Search ..... 399/35
See application file for complete search history.

(56) References Cited

U.S. PATENT DOCUMENTS 5,237,373 A * 8/1993 Aimoto et al. ..... 399/35
5,909,604 A * 6/1999 Arai ..... 399/35
6,064,850 A * 5/2000 Matsuo et al. ..... 399/333
6,157,792 A 12/2000 Mori et al. ..... 399/24
6,404,996 B1 6/2002 Mori et al. ..... 399/24
6,754,454 B1 * 6/2004 Hiroshima et al. ..... 399/25
6,766,122 B2 * 7/2004 Phillips et al. ..... 399/35

FOREIGN PATENT DOCUMENTS

JP 11-119534 4/1999
JP 11-344908 12/1999
JP 2000-231316 8/2000

OTHER PUBLICATIONS

Machine translation of JP 2002-082505 A.*

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

In an image forming apparatus includes a containing device for containing waste toner which is recovered, and a near-end position detecting device that detects that the waste toner is at a near-end position in the containing device, and a judgment feature that the waste toner is full based on image judgement means for judging whether the container after detecting means detects that an amount of toner in the container is full of toner, based on image information of an image formed on a recording material and the adjustment by the adjusting means.

3 Claims, 11 Drawing Sheets

IMAGE FORMING APPARATUS INCLUDING A TONER WASTE CONTAINER NEAR-END CONDITION DETECTION FEATURE AND A FULL CONDITION JUDGMENT FEATURE

BACKGROUND OF THE INVENTION

1. Field of the Invention

The present invention relates to an image forming apparatus which forms images on a recording material using an electrophotographic system, such as a copier and a printer.

2. Related Background Art

Heretofore, in an image forming apparatus using an electrophotographic system, desired image formation is performed through a charging process for charging a surface of a photosensitive member, an exposing process for forming an electrostatic latent image on the surface of the photosensitive member by a light beam, a developing process for making toner adhere to the electrostatic latent image formed on the surface of the photosensitive member, and manifesting this into a toner image, a primary transferring process for primarily transferring a plurality of or monochrome toner image(s) formed on the photosensitive member with being superimposed on an intermediate transferring material, a secondary transferring process for transferring the toner image(s), which is primarily transferred on the intermediate transferring material, to a recording medium such as a sheet of paper, and a fixing process for performing the heat treatment and fusion of the toner image(s) transferred on the recording medium.

When transferring a toner image from the photosensitive member to the intermediate transferring material in the primary transferring process, toner not transferred remains on the photosensitive member. Since it is necessary to remove residual toner on the photosensitive member so as to prevent the residual toner from adhering at the time of subsequent image formation, the residual toner is removed using cleaning means providing a cleaning brush, a cleaning blade, etc.

In addition, since residual toner also adheres to an intermediate transferring material in the secondary transferring process similarly to the primary transferring process, it is necessary to remove the residual toner by cleaning means.

By the way, residual toner is also generated except when image formation is normally ended as described above. That is, since a toner image is not transferred to the recording medium when an image forming process is interrupted because of JAM, sheet empty, etc., more residual toner is generated than at the normal time.

In addition, generally, a conventional image forming apparatus forms a pattern image on a photosensitive member or an intermediate transferring material, and performs an adjustment control. Such pattern image is not transferred on a recording medium, but is removed by cleaning means as residual toner in a phase when the adjustment control ends. Such residual toner removed is recovered (or collected) into a waste toner vessel by waste toner recovering (or collecting) means.

By the way, when image formation like the above is repeatedly performed, the amount of waste toner in a waste toner vessel also increases gradually. Since there is a limit in the capacity of the waste toner vessel, when waste toner is recovered more than the capacity of the waste toner vessel, waste toner overflows from the waste toner vessel to pollute an inside of an apparatus, which may also give an adverse effect to image formation, or may damage the apparatus. Therefore, before the amount of waste toner recovered in the waste toner vessel becomes full, it is necessary to replace the waste toner vessel.

Then, a sensor which detects waste toner in a waste toner vessel is provided in the vessel, and when waste toner recovered becomes full, the sensor detects this to report this to a user by displaying this, while image forming operation is inhibited. Further, after the waste toner vessel being replaced, such a control that resumes image forming operation is performed.

In order to optimally perform a waste toner full detection control as mentioned above, it is desirable to comprise a sensor for detecting the amount of waste toner before capacity full (hereafter, this is called near-end) and a full detecting sensor for detecting that the vessel is full. By the near-end detecting sensor, it is possible to prompt the preparation of a waste toner vessel for replacement by notifying a user of that it is necessary to replace the waste toner vessel, and to prompt the replacement of the waste toner vessel with inhibiting image formation at the time of the capacity full which leads to a failure of an apparatus.

However, in order to achieve the miniaturization or cost reduction of an apparatus, it is required to reduce such sensors as the above. Then, a conventional apparatus comprises only a near-end detecting sensor, and performs the control of inhibiting image forming operation by forecasting the amount of waste toner after detecting near-end. As the means of forecasting the amount of waste toner, the technology disclosed in patent documents 1 through 3 (Japanese Patent Application Laid-Opens Nos. H11-119534, H11-344908 and 2000-231316) and the like has been already proposed.

The technology proposed in the patent document 1 is constituted so as to make a near-end signal outputted from toner recovery amount detecting means when the recovery amount of non-transferred toner in a recovery vessel reaches predetermined near-end amount, to start the detection of toner supply amount to a developing device by toner supply amount detecting means when this near-end signal is outputted, and to determine with control means that the recovery vessel becomes full in a stage in which the supply amount detected reaches the predetermined amount.

In the patent document 2, it is noted that counted values used for controlling an image forming apparatus with a predetermined value contained in a nonvolatile storage medium are different when forming an image in a first image formation mode and when forming an image in a second image formation mode. Then, since maximum values of waste toner contained in a containing machine differ, the above-mentioned first image formation mode and the above-mentioned second image formation mode are constituted so that different counted value according to image formation mode may be used.

Technology proposed in the patent document 3 is constituted so as to forecast the executable amount of image formation until a waste toner containing vessel becoming full on the basis of the image formation history when near-end position detecting means detects the near-end of the waste toner containing vessel, and to display that the waste toner containing vessel is full when the amount of image formation concerned reaches the forecast amount.

Nevertheless, all among the conventional technology with means of detecting the near-end of each waste toner vessel have following problems.

Thus, first, the technology for forecasting the amount of waste toner on the basis of image data or toner supply amount does not distinguish between the amount in the case where image formation is terminated normally, and the case where image formation is interrupted. As mentioned above, waste toner is generated also in the case of the interruption of image formation such as JAM and sheet empty. The amount of waste toner generated in the case where image formation is normally terminated and in the case where image formation is interrupted, such as JAM and sheet empty differs largely. In contrast to the amount of waste toner generated at the time of normally-terminated image formation being several tens percent of full toner images, there is more amount of waste toner generated at the time of image formation being interrupted, and for example, the toner of the amount which is equivalent to all the toner images at maximum is contained in a waste toner vessel as waste toner.

When the amount of waste toner at the time of abnormal image formation is treated similarly to that at the time of normal one when forecast is performed without distinguishing between the case of normal image formation and the case of interrupted image formation such as JAM and sheet empty (at the time of abnormality), there is more amount of waste toner than forecast amount, and hence, there is a high possibility that a waste toner vessel overflows. In addition, when it is forecast in consideration of a safety aspect that the amount of waste toner of all the images is similar to that at the time of JAM or sheet empty occurrence, a margin is left in the waste toner vessel, and hence, there arises a malfunction that image formation is inhibited although image formation is still possible.

A second problem is a respect of not estimating the amount of waste toner generated in an adjustment control of using a pattern image. For example, a color image forming apparatus which superimposes a plurality of toner images to form an image performs such a control of correcting the starting position of each color by forming pattern images for registration so as to superimpose each toner image correctly.

In addition, an image forming apparatus using two-component toner forms a pattern image, detects the density of the pattern image, and performs a correction control of a T/C ratio on the basis of the detection result, in order to set the T/C ratio (a ratio between toner and carrier) in a developing device.

As mentioned above, although the examples are given about adjustment means using pattern images, plenty of adjustment controls which use pattern images exist besides the above-mentioned examples. When not adding the amount of waste toner generated in these adjustment means in a forecast control, the actually contained amount of waste toner increases more than forecast amount, and there arises a possibility that waste toner overflows.

Furthermore, when the amount of waste toner is forecast on the basis of an image formation history and much JAM and sheet empty arise after near-end detection, the amount of waste toner may be estimated few. When a portion of an apparatus is failed, or when a part deteriorates, there may also arise many cases that image formation is suddenly interrupted by JAM and the like. Since a frequency of adjustment controls being performed also varies according to the aging and environment of an apparatus, it is difficult to say that the amount of waste toner is correctly forecast.

SUMMARY OF THE INVENTION

The present invention was made in view of the above-mentioned problems, and aims at providing an image forming apparatus which can forecast the accurate amount of waste toner without causing a cost hike or the upsizing of the apparatus.

In order to achieve the above-described object, the invention is characterized in that, in an image forming apparatus which has an image bearing member for bearing a toner image developed with toner, transferring means for transferring the toner image to another medium, cleaning means for recovering waste toner which remains on the image carrier, containing means for containing the waste toner which is recovered, near-end position detecting means for detecting that the waste toner is contained to a near-end position of the containing means, image information detecting means for detecting information about an image on the image bearing member, and image formation state recognizing means for recognizing an image formation state, the image forming apparatus comprising full determining means which accumulates image amount on the basis of detection result by the image information detecting means, and recognition result by the image formation state recognizing means when it is detected by the near-end position detecting means that the waste toner is contained to a near-end position in the containing means, and determines that the waste toner becomes full when the accumulation result reaches a predetermined value.

According to another aspect of the invention, an image detected by the image information detecting means includes a pattern image for an adjustment control of the apparatus.

According to a further aspect of the invention, it is possible to determine whether image formation is terminated normally.

According to a further aspect of the invention, the image formation state recognizing means can determine whether image formation is terminated normally, and also measures a total amount of toner images, which remain on the image bearing member on the basis of detection result by the image information detecting means, when image formation is not terminated normally.

According to a further aspect of the invention, the image forming apparatus comprises adjusting means for applying the predetermined amount of toner image, which cannot be detected by the image information detecting means, on an image bearing member, and memory means for storing beforehand the pixel amount of a toner image which cannot be detected by the image information detecting means, and that the image forming apparatus accumulates the pixel amount, stored in the memory means, on the accumulation result of pixel amount used by the near-end position detecting means, and performs the determination of waste toner full on the basis of the accumulation result.

According to a further aspect of the invention, a toner image which cannot be detected by the image information detecting means is a toner image obtained by setting a developing bias applied to the developing means, and a charging bias applied to the charging means to be predetermined values different from those at the time of image formation.

According to the present invention, while preventing a cost hike and the upsizing of an apparatus which are generated by using a plurality of sensors, it becomes possible to forecast the accurate amount of waste toner. Then, it becomes possible to correspond to various changes of a status of use of an apparatus, and it is possible to use a waste toner vessel, which a user needs to purchase, as efficiently as possible.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of the present invention will be explained on the basis of accompanying drawings below.

Embodiment 1

Figure 1:
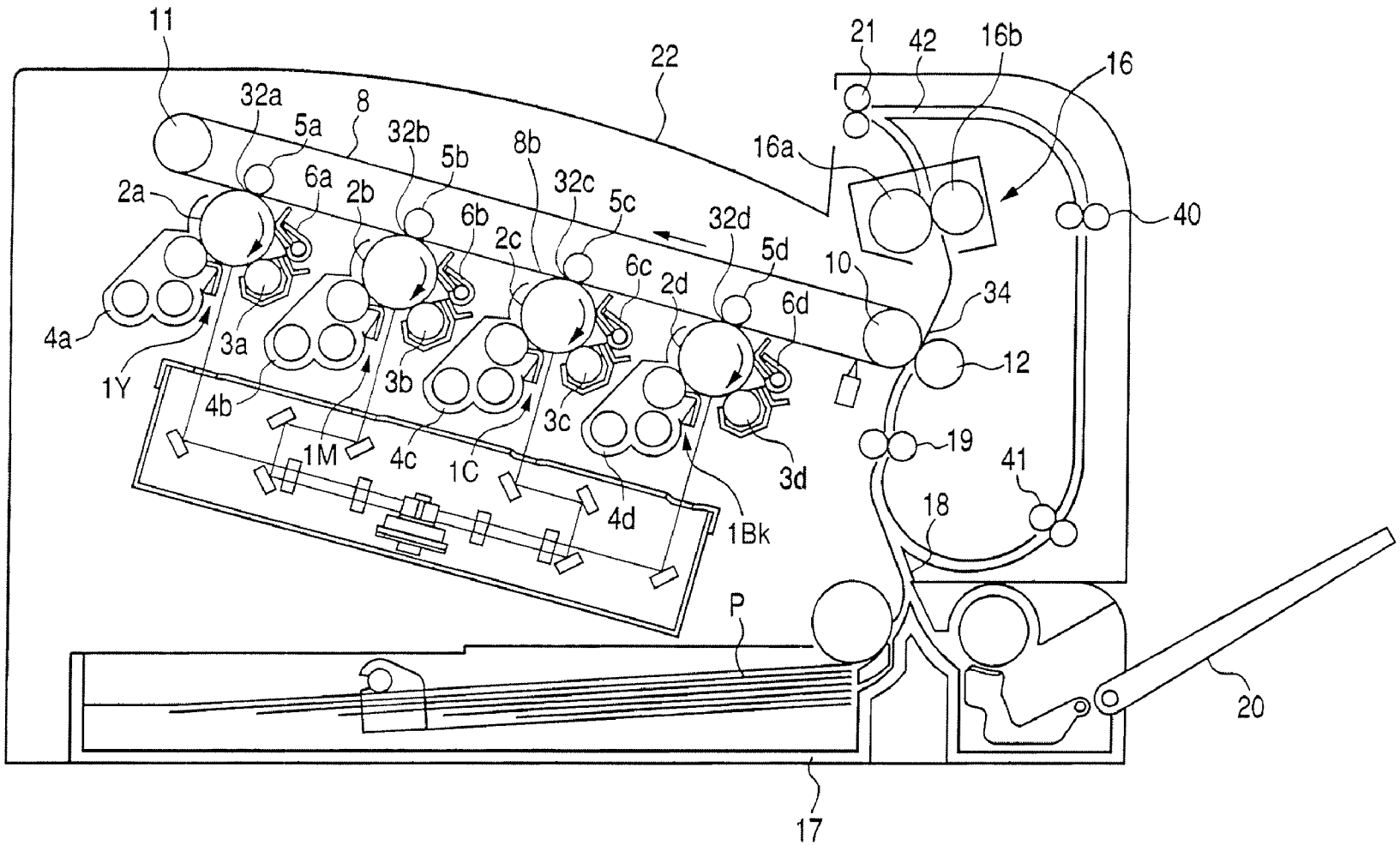
FIG. 1 is a vertical sectional view of an image forming apparatus relating to the present invention.

FIG. 1 is a sectional view of a full color printer as a form of an image forming apparatus which relates to the present invention, and this full color printer comprises four image forming portions (image formation units): an image forming portion 1Y which forms an yellow image, an image forming portion 1M which forms a magenta image, an image forming portion 1C which forms a cyan image, and an image forming portion 1Bk which forms a black image. These four image forming portions 1Y, 1M, 1C and 1Bk are lined at constant intervals.

Drum type electrophotographic photosensitive members (hereinafter photosensitive drums) 2*a*, 2*b*, 2*c* and 2*d* as image bearing members are installed in the above-mentioned image forming portions 1Y, 1M, and 1C and 1Bk, respectively. Then, around the photosensitive drums 2*a* 2*b*, 2*c* and 2*d*, primary charging devices 3*a*, 3*b*, 3*c* and 3*d*, developing apparatuses 4*a*, 4*b*, 4*c* and 4*d*, transferring rollers 5*a*, 5*b*, 5*c* and 5*d* as transferring means, and drum cleaning apparatuses 6*a*, 6*b*, 6*c* and 6*d* are located respectively, and a laser exposing apparatus 7 is installed below between the primary charging devices 3*a*, 3*b*, 3*c* and 3*d*, and developing apparatuses 4*a*, 4*b*, 4*c* and 4*d*.

Yellow toner, cyan toner, magenta toner, and black toner are contained in the developing apparatuses 4*a*, 4*b*, 4*c* and 4*d*, respectively.

The photosensitive drums 2*a*, 2*b*, 2*c* and 2*d* are negatively-charged OPC photosensitive members respectively, and these have each photoconductive layer on a drum base member made of aluminum, and are rotatably driven at predetermined process speed in an arrow direction (clockwise in FIG. 1) by a driving apparatus not shown.

In addition, the above-mentioned primary charging devices 3*a*, 3*b*, 3*c* and 3*d* as primary charging means uniformly charge surfaces of the photosensitive drums 2*a*, 2*b*, 2*c* and 2*d* in the predetermined negative potential with a charging bias applied by a charging bias power supply (not shown).

The above-mentioned developing apparatuses 4*a*, 4*b*, 4*c* and 4*d* contain toner, and makes the toner in respective colors adhere to respective electrostatic latent images formed on the photosensitive drums 2*a*, 2*b*, 2*c* and 2*d* to develop (visualize) respective electrostatic latent images as toner images.

Furthermore, the above-mentioned transferring rollers 5*a*, 5*b*, 5*c* and 5*d* as primary transfer means are located contactably through an intermediate transfer belt 8 to the photosensitive drums 2*a*, 2*b*, 2*c* and 2*d* in primary transferring portions 32*a*, 32*b*, 32*c* and 32*d*, respectively.

The above-mentioned drum cleaning apparatuses 6*a*, 6*b*, 6*c* and 6*d* have each cleaning blade for removing the transfer residual toner, which remain on the photosensitive drums 2*a*, 2*b*, 2*c* and 2*d* at the time of the primary transfer, from the photosensitive drums 2*a*, 2*b*, 2*c* and 2*d*, respectively.

The above-mentioned intermediate transfer belt 8 is located above upper face sides of the photosensitive drums 2*a*, 2*b*, 2*c* and 2*d* with being tightly stretched between a secondary transfer facing roller 10 and a tension roller 11, and the secondary transfer facing roller 10 is located through the intermediate transfer belt 8 contactably to a secondary transfer roller 12 in a secondary transferring portion 34. In addition, the intermediate transfer belt 8 is constituted of dielectric resin such as polycarbonate, a polyethylene terephthalate resin film, and a polyvinylidene fluoride resin film.

In addition, the intermediate transfer belt 8 is slantly located with a primary transfer surface 8*b* being made downward in its side opposite to the secondary transfer roller 12, the primary transfer surface 8*b* being formed in a surface side opposite to the respective photosensitive drums 2*a*, 2*b*, 2*c* and 2*d*.

That is, the intermediate transfer belt 8 is slantly located with the primary transfer surface, that is, a lower plane 8*b* being made downward in its side opposite to the secondary transferring portion 34, the lower plane 8*b* being formed in a surface side opposite to the respective photosensitive drums 2*a*, 2*b*, 2*c* and 2*d* with being movably located above the photosensitive drums 2*a*, 2*b*, 2*c* and 2*d*. Specifically, this tilt angle is set at about 15°. Furthermore, the intermediate transfer belt 8 is tightly stretched with two rollers of the tension roller 11, which is located at a side facing the secondary transfer facing roller 10, which is located at a side of the secondary transferring portion 34 and gives a driving force to the intermediate transfer belt 8, sandwiches primary transferring portions 32*a* through 32*d* with the secondary transfer facing roller 10, and gives tension to the intermediate transfer belt 8 concerned, and the secondary transfer facing roller 10.

The secondary transfer facing roller 10 is located through the intermediate transfer belt 8 contactably to secondary transfer roller 12 in the secondary transfer portion 34. In addition, a belt cleaning apparatus which is not shown and removes and recovers (or collects; this is the same in the following) transfer residual toner which remains on a surface of the endless intermediate transfer belt 8 is installed outside the intermediate transfer belt 8 and near the tension roller 11. Moreover, a fixing apparatus 16 which has a fixing roller 16*a* and a pressure roller 16*b* is installed with vertical path structure in a downstream of a transfer direction of transferring material P rather than secondary transfer portion 34.

Furthermore, the above-mentioned laser exposing apparatus 7 comprises a laser beam-emitting means which performs emission corresponding to a time series electric digital pixel signal of image information given, a polygon lens, and a reflecting mirror, and forms electrostatic latent images in respective colors according to image information on the respective surfaces of the photosensitive drums 2*a*, 2*b*, 2*c* and 2*d*, which are charged by the respective primary charging devices 3*a*, 3*b*, 3*c* and 3*d*, by exposing the respective photosensitive drums 2*a*, 2*b*, 2*c* and 2*d*.

Next, the image forming operation by the full color printer which has the above structure will be explained.

When an image formation start signal is emitted, the photosensitive drums 2*a*, 2*b*, 2*c* and 2*d* of the image forming portions 1Y, 1M, 1C and 1Bk which are rotatably driven at predetermined process speed are uniformly charged in negative polarity by the respective primary charging devices 3*a*, 3*b*, 3*c* and 3*d*, respectively. Then, the laser exposing apparatus 7 emits image signals, which are inputted from the outside and are color-separated, from laser beam-emitting devices, and forms an electrostatic latent image in each color on each of the photosensitive drums 2*a*, 2*b*, 2*c* and 2*d* by emitting a laser beam via a polygon lens, a reflecting mirror, and the like on each of the photosensitive drums 2*a*, 2*b*, 2*c* and 2*d*.

Then, an electrostatic latent image is visualized as a yellow toner image by first making yellow toner adhere to the electrostatic latent image formed on the photosensitive drum 2*a* by the developing apparatus 4*a* to which the developing bias in the same polarity as the charge polarity (negative polarity) of the photosensitive drum 2*a* is applied. The primary transfer of this yellow toner image is made on the intermediate transfer belt 8 driven by the transferring roller 5*a* to which the primary transfer bias (opposite polarity (positive polarity) to the toner) is applied in the primary transferring portion 32*a* between the photosensitive drum 2*a* and transferring roller 5*a*.

The intermediate transfer belt 8 on which the yellow toner image is transferred is moved to a side of the image forming portion 1M. Then, also in the image forming portion 1M, similarly to the above, a magenta toner image formed in the photosensitive drum 2*b* is transferred with being superimposed on the yellow toner image on the intermediate transfer belt 8 in the primary transferring portion 32*b*.

Subsequently, similarly, cyan and black toner images formed in the photosensitive drums 2*c* and 2*d* of the image forming portions 1C and lBk are superimposed in turn on the yellow and magenta toner images, which are superposed and transferred on the intermediate transfer belt 8, in the primary transferring parts 32*c* and 32*d*, and a full color toner image is formed on the intermediate transfer belt 8. The transfer residual toner which remains on the photosensitive drums 2*a*, 2*b*, 2*c* and 2*d* is scraped off by cleaner blades and the like provided on the drum cleaning apparatuses 6*a*, 6*b*, 6*c* and 6*d*, and is recovered into each waste toner vessel (not shown) after being transferred by waste toner transfer means (not shown).

Then, with synchronizing with the timing when an end of the full color toner image on the intermediate transfer belt 8 is moved to the secondary transferring portion 34 between the secondary transfer facing roller 10 and secondary transfer roller 12, the transferring material (paper) P which is selected from a sheet feeding cassette 17 or a manual feed tray 20 and is fed through a transfer path 18 is transferred by a registration roller 19 to the secondary transferring portion 34. Then, the full color toner image is made to be secondarily transferred to the transferring material P transferred to the secondary transferring portion 34 by the secondary transfer roller 12 to which the secondary transfer bias (opposite polarity (positive polarity) to the toner) is applied.

Subsequently, the transferring material P on which the full color toner image is transferred to the fixing apparatus 16. The full color toner image is heated and pressurized in a fixing nip portion between the fixing roller 16*a* and pressure roller 16*b* to be thermally fixed on a surface of the transferring material P. Thereafter, the transferring material P is discharged on a sheet discharging tray 22 on a top face of the main body by a sheet discharging roller 21. Then, a series of image forming operations are completed. Secondary transfer residual toner which remains on the intermediate transfer belt 8 is removed by a belt cleaning apparatus not shown, and is transferred by waste toner transferring means (not shown) to be recovered into a waste toner vessel (not shown).

The above is the image forming operation at the time of simplex image formation.

Next, a double-sided image forming operation by a full color printer which relates to this embodiment will be explained.

This process is the same as that of a simplex image forming operation up to the process of the transferring material P being transferred in the fixing apparatus 16. Then, the full color toner image is heated and pressurized in the fixing nip portion between the fixing roller 16*a* and pressure roller 16*b* to be thermally fixed on the surface of the transferring material P. Thereafter, the rotation of sheet discharging roller 21 is stopped in the state that the most of the transferring material P is discharged on the sheet discharging tray 22 on the top face of the main body by the sheet discharging roller 21. At that time, the transferring material P is stopped so that its rear edge position may have arrived at a reversible position 42.

Subsequently, in order to send the transferring material P, whose transfer is stopped by the rotation of the sheet discharging roller 21 being stopped, to a double-sided path provided with double-sided rollers 40 and 41, the sheet discharging roller 21 is rotated in a direction reverse to that of a normal rotation. A rear edge side of the transferring material P which positions in a reversal position 42 is made to arrive at the double-sided roller 40 as a front end side by the sheet discharging roller 21 being reversely rotated.

After that, the transferring material P is transferred to the double-sided roller 41 by the double-sided roller 40. The transferring material P is sequentially transferred toward the registration roller 19 by the double-sided rollers 40 and 41. In the meantime, an image formation start signal is generated. Similarly to the above-mentioned simplex image formation, in synchronization with the timing when an end of the full color toner image on the intermediate transfer belt 8 is moved to the secondary transferring portion 34 between the secondary transfer facing roller 10 and secondary transfer roller 12, the transferring material P is moved to the secondary transferring portion 34 by the registration roller 19.

The end of the toner image and the end of the transferring material P is made to coincide in the secondary transferring portion 34, and the toner image is transferred to an opposite side of the transferring material P. Thereafter, similarly to the simplex image forming operation, the toner image on the transferring material P is fixed by the fixing apparatus 16, and the transferring material P on which the toner image is fixed is again transferred by the sheet discharging roller 21. Then, the transferring material P is finally discharged on the sheet discharging tray 22, and a series of image forming operations are completed.

Figure 2:
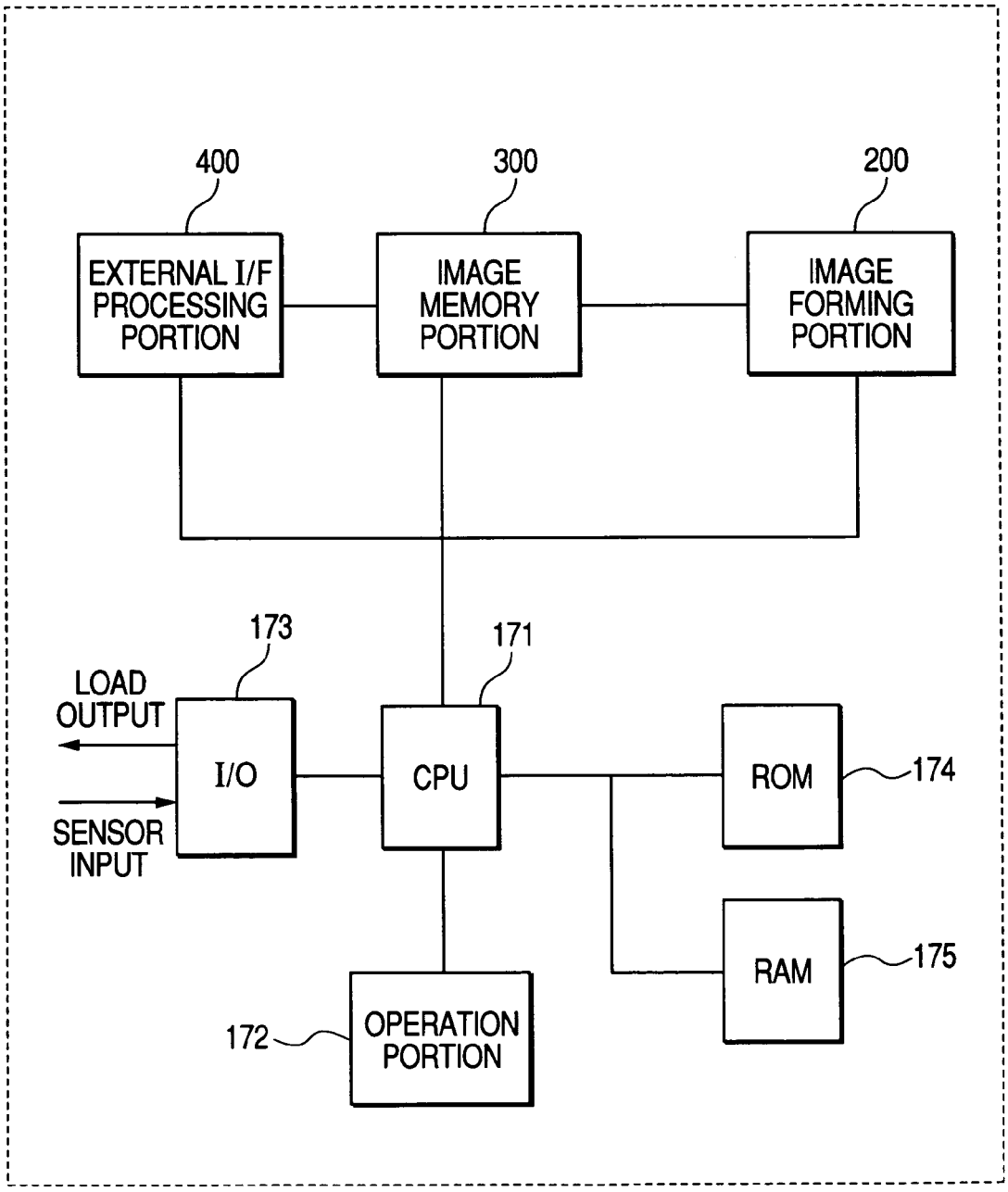
FIG. 2 is a block diagram showing the structure of a control system of the image formation apparatus relating to the present invention.

FIG. 2 is a block diagram showing the structure of a control system of a full color printer.

In FIG. 2, reference numeral 171 denotes a CPU which performs the basic control of the full color printer. ROM 174, in which a control program is written, work RAM 175 for processing, and an input-output port (I/O) 173 are connected to this CPU 171 by an address bus and a data bus. Then, various loads (not shown) such as a motor and a clutch which control the full color printer, and inputs (not shown) such as a sensor which detects a position of paper are connected to the input-output port (I/O) 173.

The CPU 171 executes image forming operation by sequentially controlling input-output through the input-output port 173 according to the content of the ROM 174. An operation portion 172 is connected to the CPU 171 and controls display means and key input means of the operation portion 172. An operator instructs the CPU 171 to switch an image forming operation mode or display through the key input means, and the CPU 171 makes the state of the full color printer and the operation mode setting by a key input displayed. In addition, an external I/F processing portion 400 which transmits and receives image data, processing data, and the like from external equipment such as a PC, an image memory portion 300 which performs extension processing of an image, temporary accumulation processing, and the like, and an image forming portion 200 which performs processing so as to make line image data, which is transferred from the image memory portion 300, exposed by the laser exposing apparatus 7 are connected to the CPU 171.

Figure 3:
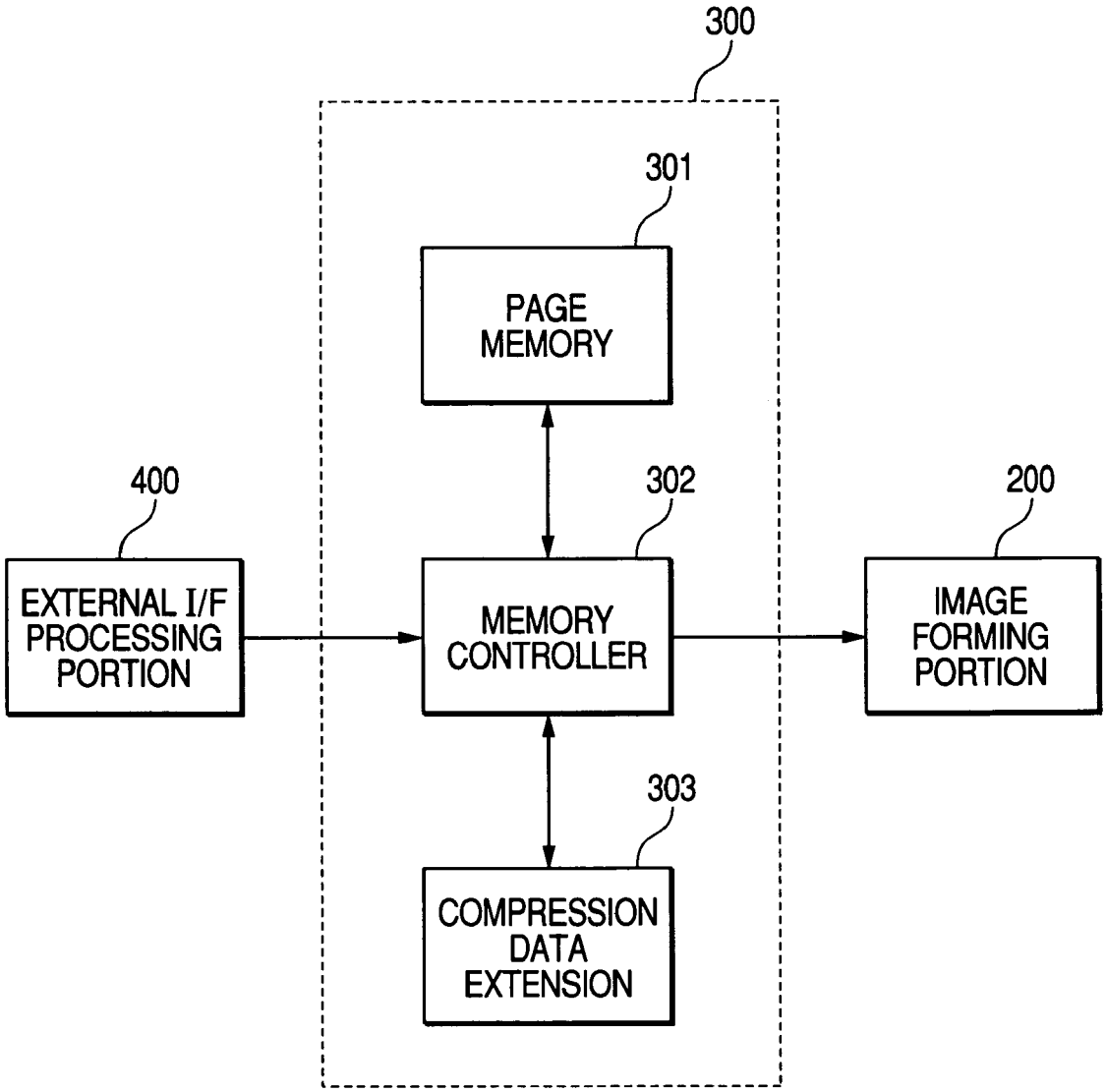
FIG. 3 is a block diagram showing the structure of an image memory portion of the image forming apparatus relating to the present invention.

Next, on the basis of FIG. 3, the structure of the above-mentioned image memory portion 300 will be explained in detail.

The image memory portion 300 performs input-output accesses of an image such as writing image data, received from the external I/F processing portion 400 through a memory controller 302, into page memory 301 which comprises memory such as DRAM, and reading an image into the image forming portion 200.

The memory controller 302 determines whether the image data, which is received from external equipment, from external I/F processing portion 400 is compressed data. When it is determined that it is compressed data, extension processing is performed using a compressed data extension processing portion 303. Thereafter, writing processing into the page memory 301 is performed through the memory controller 302.

The memory controller 302 generates a DRAM refresh signal of the page memory 301, and arbitrates access to the page memory 301 between the writing from image I/F processing portion 400 and the reading into the image forming portion 200. Furthermore, the memory controller 302 controls a writing address into the page memory 301, a reading address from the page memory 301, a reading direction, and the like according to the instruction of the CPU 171.

Figure 4:
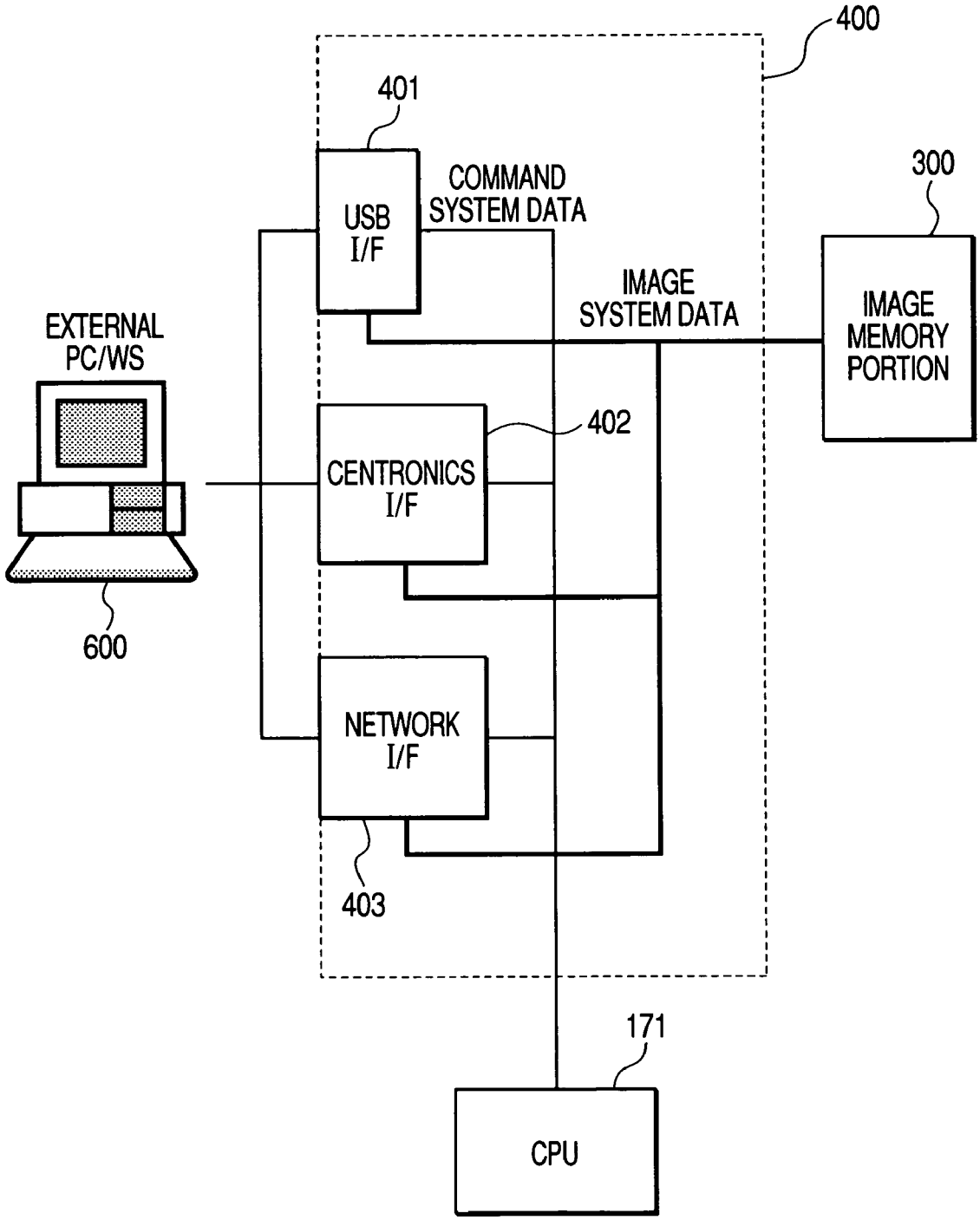
FIG. 4 is a block diagram showing the structure of an external I/F processing portion of the image forming apparatus relating to the present invention.

Next, based on FIG. 4, the structure of external I/F processing portion 400 will be explained.

The external I/F processing portion 400 receives image data, which is transmitted from an external apparatus 600, and print command data through any one of a USB I/F portion 401, a centronics I/F portion 402, and a network I/F portion 403, and transmits the state information of the image forming apparatus (full color printer), which is determined by the CPU 171, to the external apparatus 600. Here, the external apparatus 600 is a computer, a workstation, or the like.

The print command data which is received from the external apparatus 600 through any one of the USB I/F portion 401, centronics I/F portion 402, and network I/F portion 403 is processed in the CPU 171 to generate the setting and timing of executing print operation using the image forming portion 200, input-output port (I/O) 173 shown in FIG. 2, or the like. Image data which is received from the external apparatus 600 through any of the USB I/F portion 401, centronics I/F portion 402, and network I/F portion 403 is transmitted to the image memory portion 300 according to the timing based on print command data to be processed so that image formation may be made by the image forming portion 200.

Next, a waste toner vessel relating to the present invention will be explained.

Figure 5:
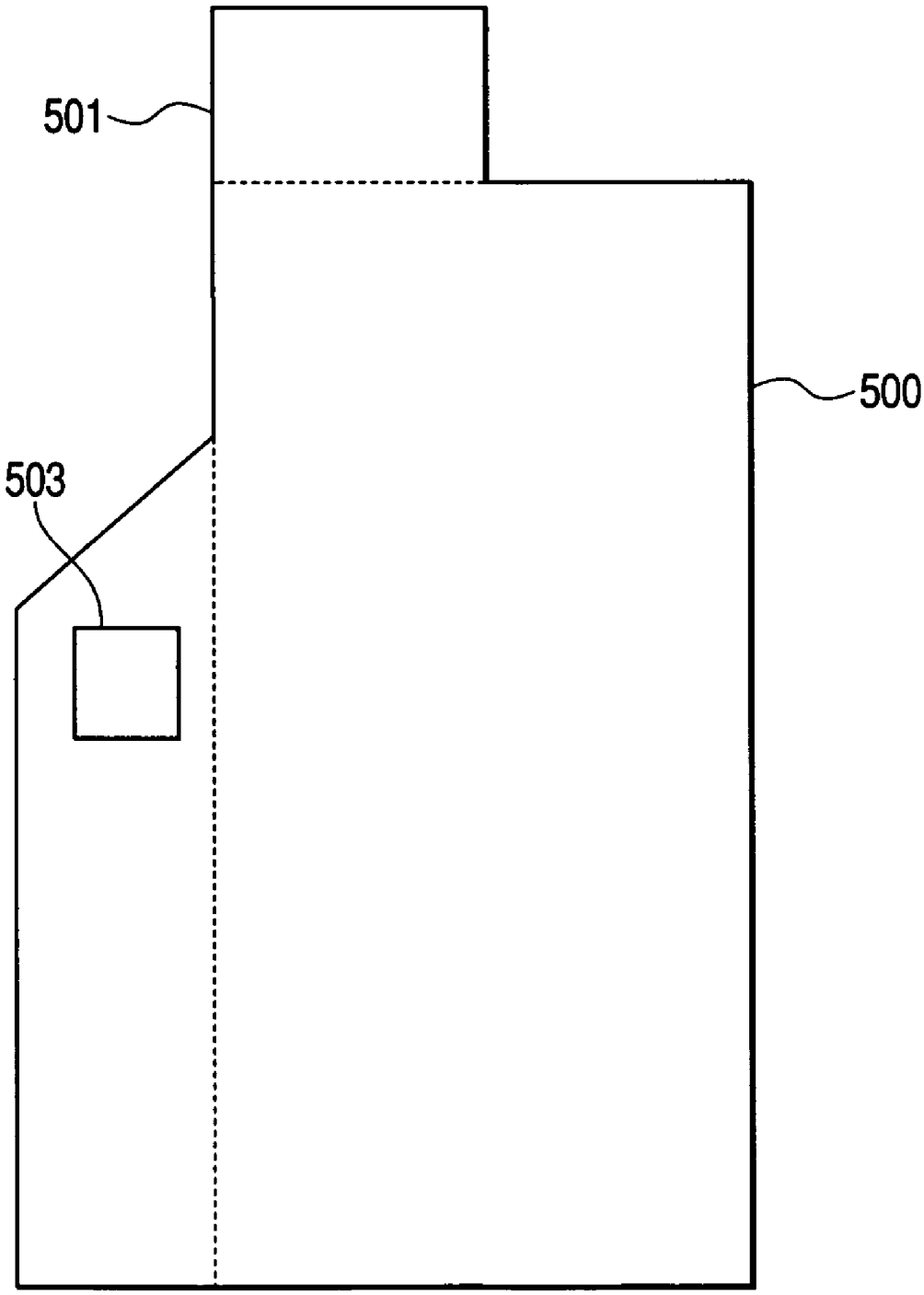
FIG. 5 is a sectional view of a waste toner vessel of the image forming apparatus relating to the present invention.
Figure 6:
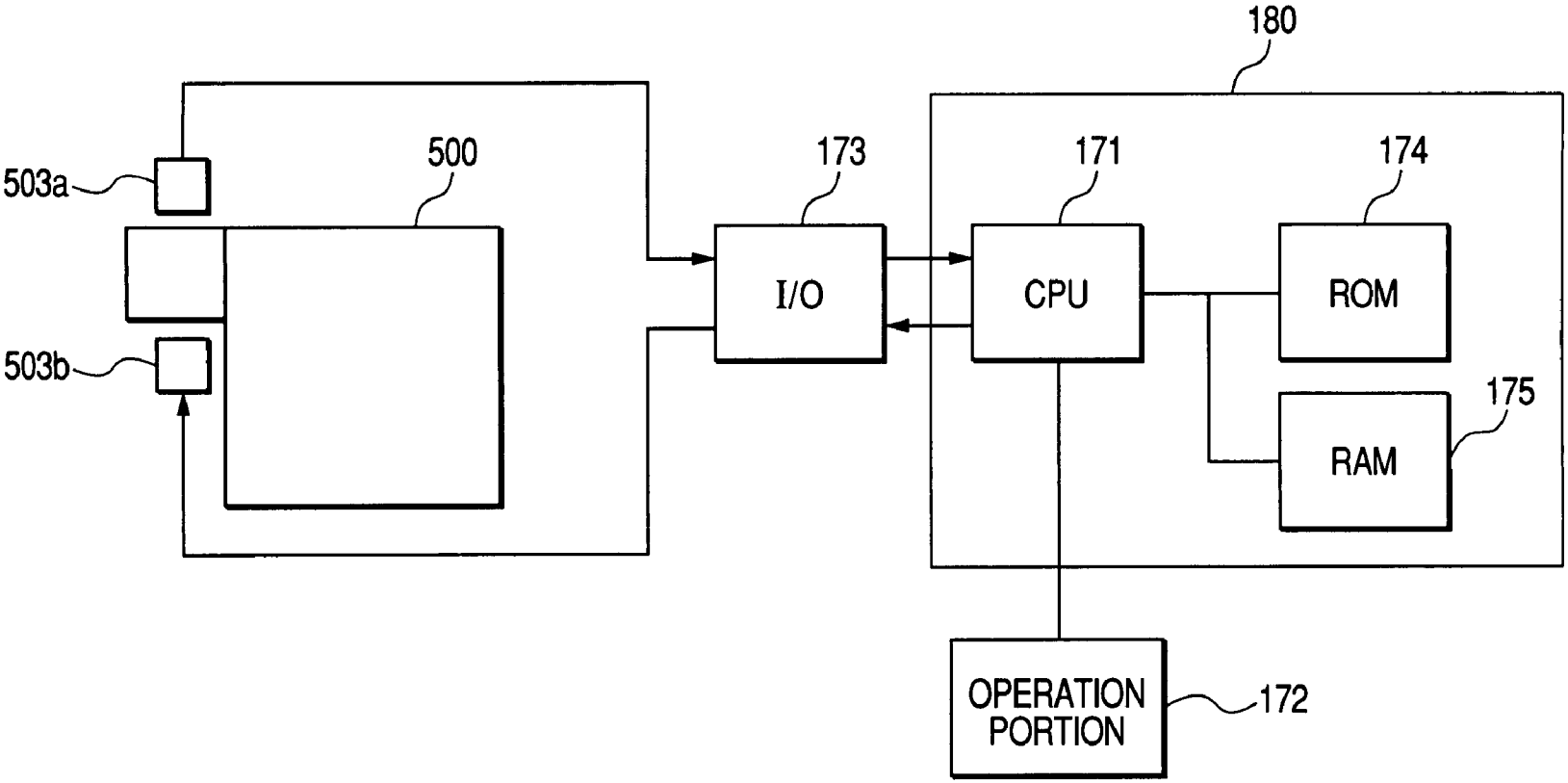
FIG. 6 is a diagram showing the relation between the waste toner vessel and control blocks to which the present invention is applied.

FIG. 5 is a sectional view of a waste toner vessel, and FIG. 6 includes a top view of the waste toner vessel, and a block diagram showing the structure of a control portion.

Waste toner removed by the above-mentioned drum cleaning apparatuses 6*a*, 6*b*, 6*c* and 6*d* shown in FIG. 1, and waste toner removed by the belt cleaning apparatus not shown are transferred to a waste toner transfer opening 501 of the waste toner vessel 500 by transferring means not shown to be contained in the waste toner vessel 500. Then, the waste toner contained in the waste toner vessel 500 increases by repeated image formation. Near-end is detected when the waste toner is contained to a waste toner near-end detecting sensor 503. Here, a transmission type sensor is used for the waste toner near-end detecting sensor 503, and this waste toner near-end detecting sensor 503 comprises a light-emitting device 503*b* and a light-receiving device 503*a* as shown in FIG. 6. When the volume of the waste toner in the waste toner vessel 500 increases and the waste toner screens an optical path of infrared light outputted from the light-emitting device 503*b*, the light-receiving device 503*a* can detect this. Although an optical sensor is used for the waste toner near-end detecting sensor 503 in this embodiment, another type sensor can be used and the present invention is not limited to this.

The detection result of the light-receiving device 503*a* is transmitted to the CPU 171 through the input-output port (I/O) 173, and control means 180 performs the control of the image forming apparatus (full color printer) and display for the operation portion 172 according to the detection result of the light-receiving device 503*a*. That is, when the light-receiving device 503*a* is detecting light, waste toner is not contained to the position of the near-end detecting sensor 503, and hence, image formation is allowed. When the light-receiving device 503*a* cannot detect the light, it is displayed on the operation portion 172 that the waste toner is near to full, which prompts a user to prepare a new waste toner vessel.

Figure 7:
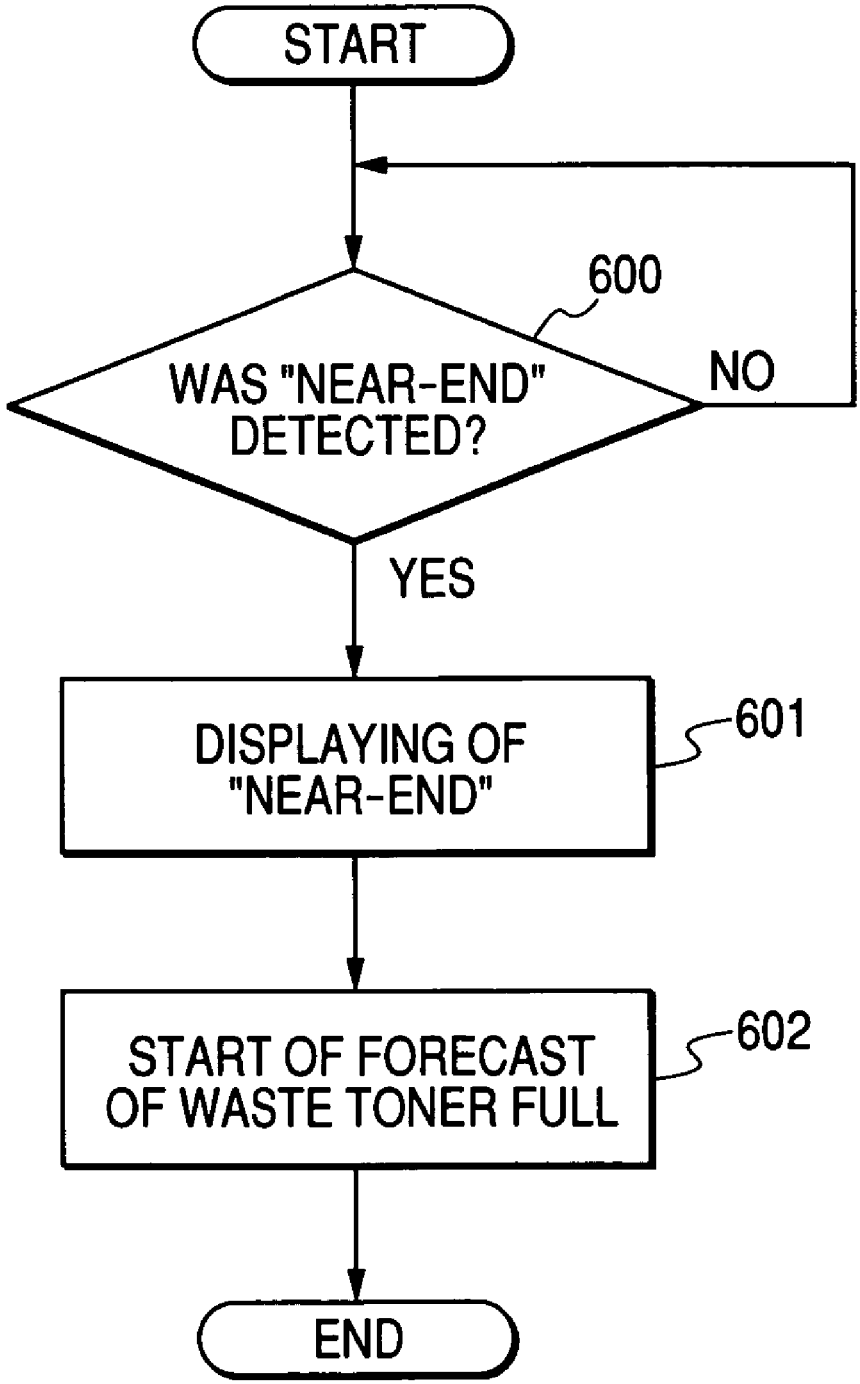
FIG. 7 is a flowchart showing a waste toner near-end detection sequence.

FIG. 7 shows the waste toner near-end detection sequence explained above.

That is, when image formation is started, it is determined whether near-end is detected by the near-end detecting sensor 503 (step 600). When near-end is detected (when the determination result at step 600 is YES), near-end is displayed in the operation portion 172 (step 601), and a waste toner full forecast is started (step S602).

Then, the above-mentioned waste toner full forecast is made as follows.

Next, the waste toner full forecast after waste toner being contained to the near-end will be explained.

The waste toner full forecast proposed in the present invention is the control that the amount of waste toner contained in a waste toner vessel is measured and accumulated as waste toner about each of controls that toner is applied on a photosensitive member and an image bearing member such as intermediate transferring material, and a full forecast is performed using the accumulation result. The controls relating to the present invention that toner is applied on an image bearing member are enumerated below.

(1) Image formation control that transfer on a recording medium is terminated normally (2) Apparatus adjustment control that a pattern image is formed as the adjustment means of an apparatus (3) Image formation interruption control at the time of an emergency stop in image formation controls (1) and (2)

(4) Apparatus adjustment control that a toner image whose image data cannot be measured is applied on an image bearing member as adjustment means of the apparatus.

Each of the above-mentioned controls (1) through (4) and the amount of waste toner generated in each control will be explained in detail.

As mentioned above, all the toner images formed on a photosensitive member at the time of the normal image formation shown in item (1) are not transferred on a recording medium. According to various conditions such as DUTY of an image to be formed, a type of a recording medium, and an environment, residual toner is generated on an image bearing member. Although the residual toner image generated to the formed toner image changes according to the structure of an apparatus and the like, about 10 to 30 percent of the residual toner is generated.

Next, the apparatus adjustment control (2) that a pattern image is formed as the adjustment means of the apparatus will be explained.

An electrophotographic image forming apparatus comprises various adjustment means in many cases so as to correspond to aging or an environment. Means of forming a pattern image on an image bearing member, and using the measurement result of the pattern image for feedback control is known as the adjustment means.

An example of the above-mentioned adjustment means will be explained.

For example, an image forming apparatus is proposed, the image forming apparatus which can form a color image with a method of performing the multiplex transferring of respective formed toner images to a transferring part in the case of an image forming portion which develops a multicolor electrostatic latent image by a developing apparatus and forms a visible image (toner image), and performing batch transfer to transferring material. In this kind of image forming apparatus, images formed on respective photosensitive drums do not coincide finally with each other on transferring material because of factors such as a mechanical mounting error between photosensitive drums, an emitting position error of each laser beam, and optical path fluctuation.

Figure 9:
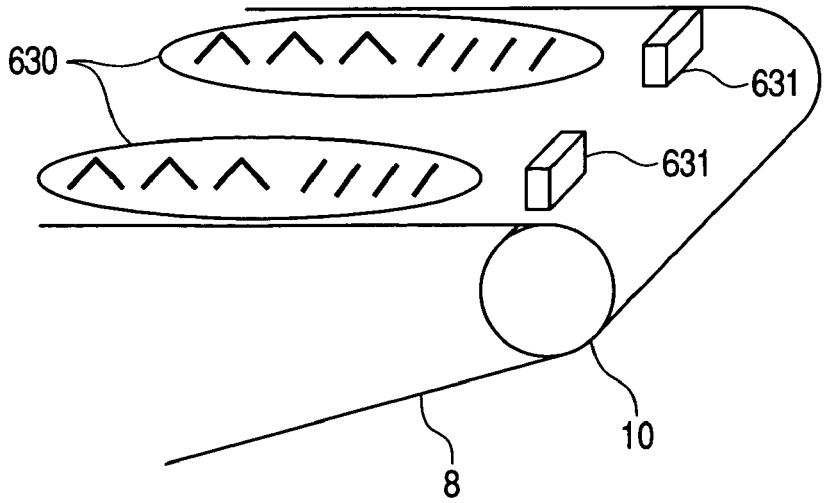
FIG. 9 is an explanatory diagram of registration shift detection means.

For this reason, automatic color shift correction control is commonly used, the automatic color shift correction control that a color shift pattern image 630 (refer to FIG. 9) for color shift detection is formed on an endless belt such as a transfer conveying belt or the intermediate transfer belt 8, shown in FIG. 9, from each photosensitive drum, the image 630 is read by a device 631 (refer to FIG. 9) such as a CCD or a PD sensor, and the registration shift corresponding to each color is detected and corrected using various correction means.

All the pattern images an example of which is the color shift pattern image 630 are contained in a vessel as waste toner without being transferred to a recording medium. Since an implementation frequency also changes according to a state and an environment of an apparatus, it is not possible to disregard these adjustment means so as to forecast the amount of waste toner accurately. Although registration shift correction is cited as an example of adjustment means using a pattern image in this embodiment, the present invention is not limited to this. For example, the present invention has the structure that all the adjustment means of forming a pattern image, such as density correction control of performing T/C ratio correction in a developing apparatus can be implemented.

Figure 8:
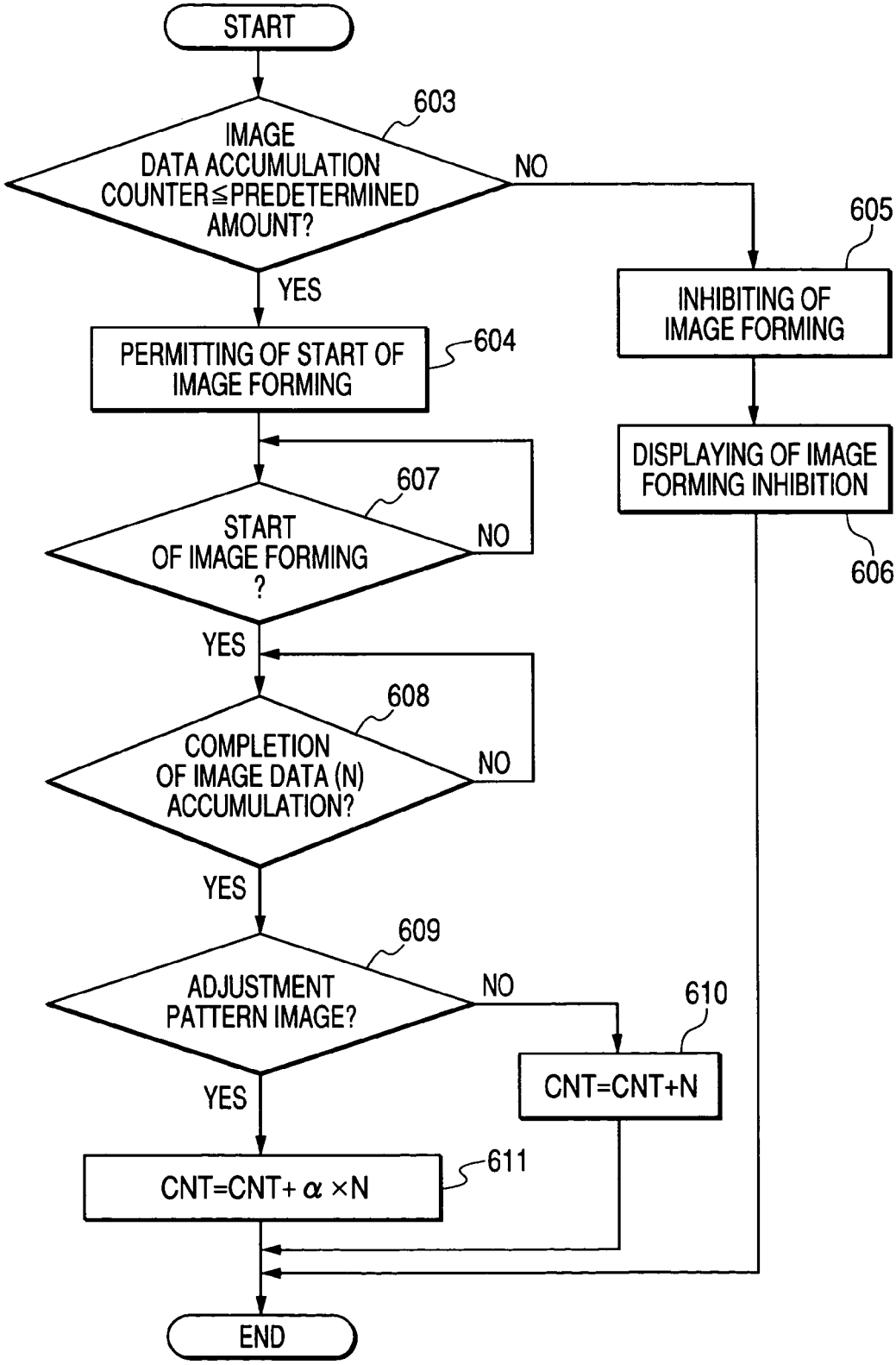
FIG. 8 is a flowchart showing a waste toner forecast sequence.

The amount-of-waste-toner forecast sequences in the controls (1) and (2) will be explained on the basis of FIG. 8.

An image data accumulation counter (CNT) is compared to an accumulation count value at which a waste toner vessel becomes full and is calculated beforehand, at the time of start of image formation (step 603). When image data accumulation count value is less than a predetermined value (when the determination result at step 603 is YES), the start of image formation is permitted (step 604). When exceeding the predetermined value (when the determination result at step 603 is NO), image formation is inhibited (step 605). Further, it is displayed that the waste toner vessel becomes full (step 606).

On the other hand, when the start of image formation is permitted, it is determined whether the image formation is started (step 607). When the image formation is started (when the decision result at step 607 is YES), it is determined whether the accumulation of image data (N) is completed (step 608). The image forming portion 200 shown in FIG. 2 performs the accumulation of image data (N), and monitors the completion of the accumulation to read accumulation result when it is completed.

After the completion of accumulation of image data (N), it is determined whether image data created is a pattern image for adjustment or an image which is transferred on the recording medium (step 609). When it is the pattern image for adjustment (when the decision result of step 609 is NO), an image data measurement N is added to the accumulation counter value CNT (CNT =CNT +N: step 611). When being the normal image data (when the decision result of step 609 is YES), the multiplication result of the image data measurement N multiplied by a coefficient $\alpha$ is added in consideration of a transfer efficiency (CNT =CNT +$\alpha\times$N: step 611).

The above processing is repeated every image formation, and image formation is permitted so long as the image data accumulation counter value CNT is less than the predetermined value.

As described above, according to this embodiment, since a normal image is distinguished from a pattern image used for adjustment means and the determination of waste toner full is performed, it is possible to perform a waste toner forecast accurately.

Embodiment 2

Next, the above-described control (3) will be explained.

When an emergency stop arises during image formation, residual toner is generated on an image bearing member. Then, the amount of residual toner in that case varies according to an emergency stop factor. As for the emergency stop factor, for example, sheet empty and JAM can be cited.

Next, a measuring method of amount-of-residual-toner at the time of occurrence of sheet empty will be explained.

Figure 11:
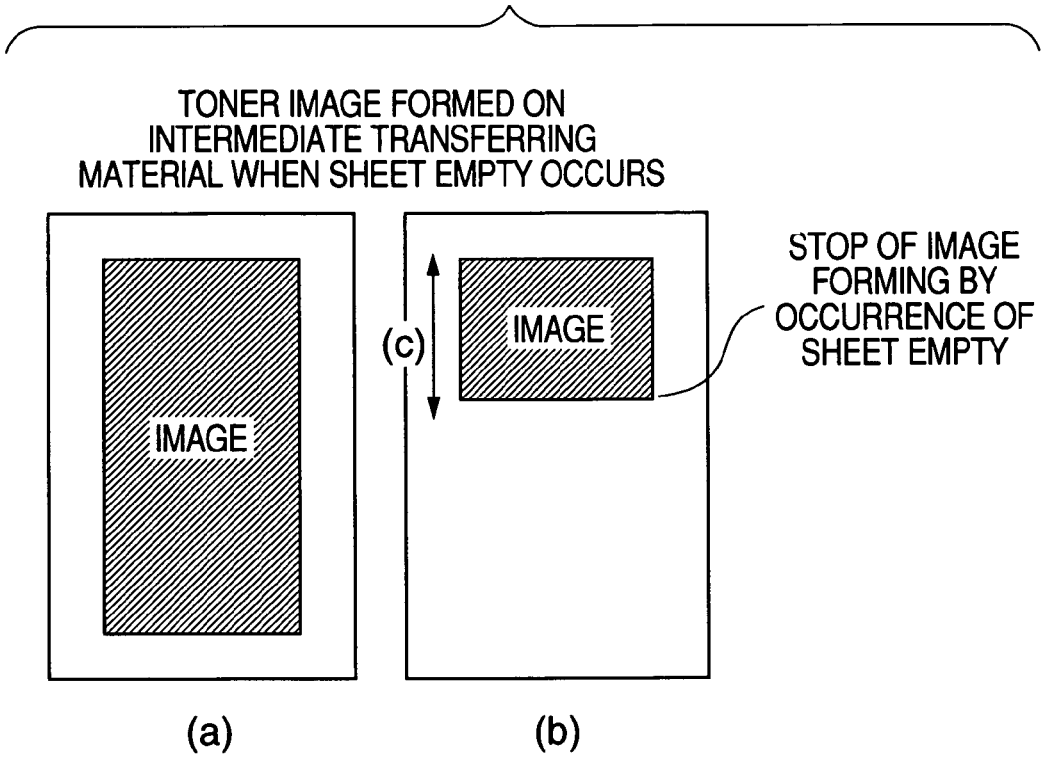
FIG. 11 is a drawing showing in a duplex manner toner images which remain on an intermediate transferring material when sheet empty occurs.

(a) of FIG. 11 shows a toner image on intermediate transferring material at the time of image formation, and (b) of FIG. 11 shows a toner image when sheet empty arises, respectively. In many image forming apparatuses which are requested to be at high productivity, it is necessary to start image formation before the confirmation of that there is a recording medium. In addition, the timing when the apparatuses are stopped after sheet empty is detected varies.

A measured object of residual toner at the time of occurrence of sheet empty becomes the amount of electrostatic latent images being formed by a semiconductor laser, that is, the number of image data counted by the image forming portion 200. Even if the timing when emergency stops arise is various and the locations where residual toner arises are any on a photosensitive member and intermediate transferring material, the amount of waste toner corresponding to the number of electrostatic latent images which are formed arises.

Next, a measuring method of amount-of-residual-toner at the time of JAM occurrence will be explained.

Figure 12:
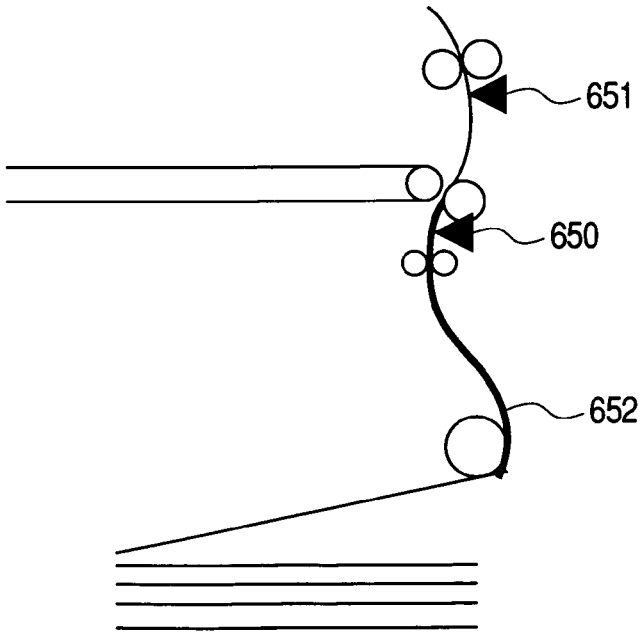
FIG. 12 is an explanatory diagram of the amount of waste toner when JAM occurs.
Figure 13:
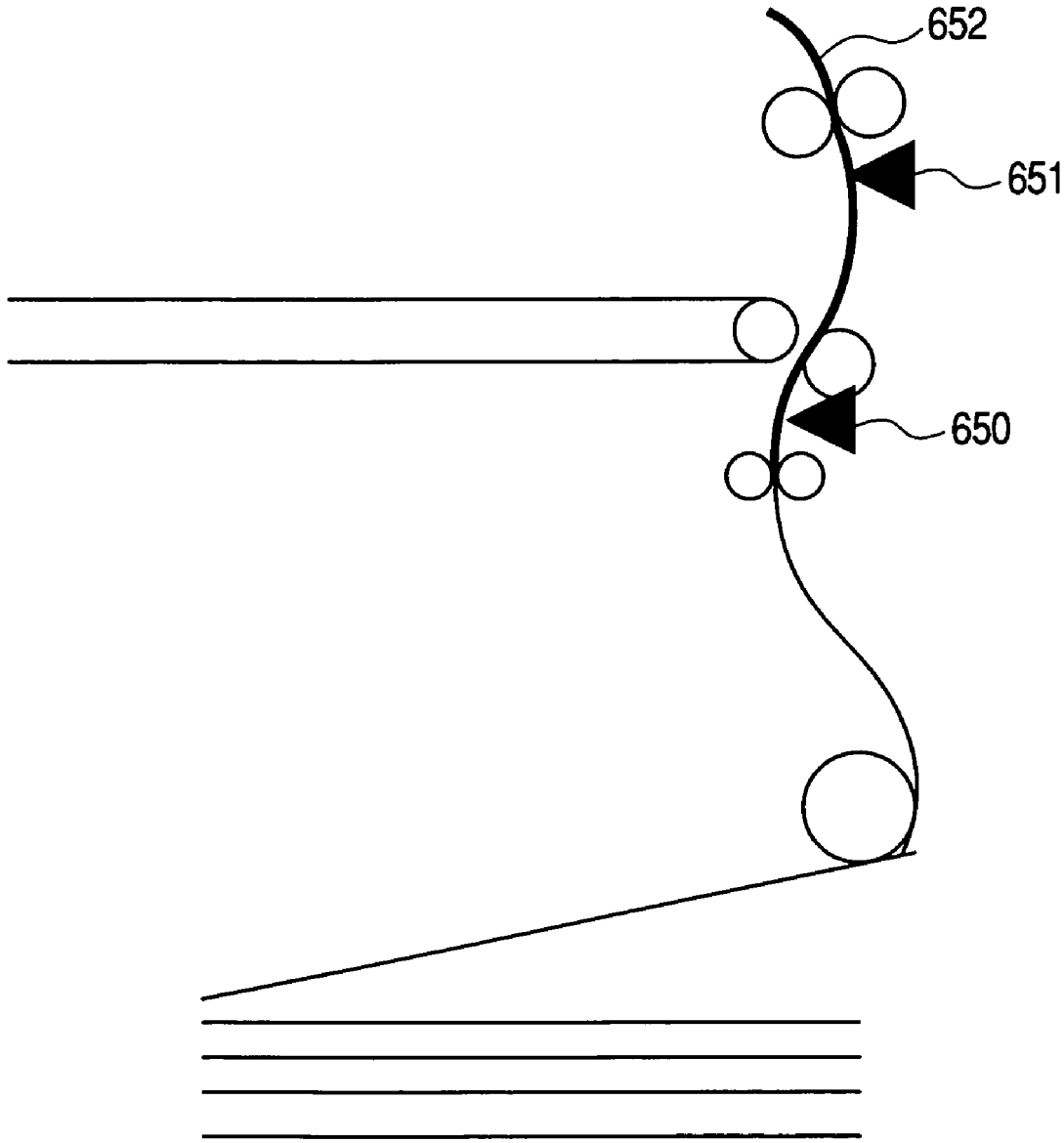
FIG. 13 is an explanatory diagram of the amount of waste toner when JAM occurs.

A position of a recording medium at the time of JAM occurrence is usually detected by a sensor provided on a paper conveying path (hereafter, this is called a paper path). It is possible to calculate the amount of residual toner uniquely according to a position of a recording medium on a paper path. FIGS. 12 and 13 show its examples.

FIG. 13 expresses the paper path in this embodiment in a duplex manner. As a sensor for detecting a JAM position, a sensor 650 and a sensor 651 are provided. In FIGS. 12 and 13, a thick line 652 denotes a recording medium. The state that FIG. 12 shows denotes that an output of the sensor A650 is ON, and an output of the sensor B651 is OFF. In this case, all the toner images formed on the intermediate transferring material become waste toner.

The state which FIG. 13 shows denotes that a recording medium stops in a position where outputs of the sensors A650 and B651 become ON. In this case, toner in a ratio A of a toner image formed on intermediate transferring material is transferred on a recording medium and toner in a residual ratio B remains on the intermediate transferring material. The above-mentioned ratios A and B vary according to the structure of an apparatus and sensor positions. It becomes possible to measure the accurate amount of waste toner by preparing beforehand the ratios A and B according to the structure of each apparatus.

Figure 10:
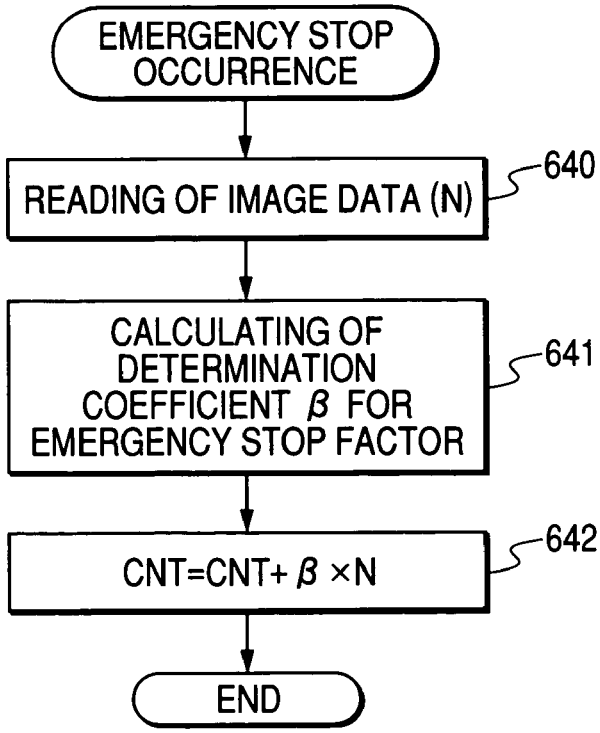
FIG. 10 is a flowchart showing the amount-of-waste-toner forecast sequence at the time of an emergency stop.

FIG. 10 shows an amount-of-waste-toner forecast sequence when an emergency stop arises.

After the emergency stop arises, image data N is read (step 640). Next, an emergency stop factor is determined and a coefficient value β according to the factor is calculated (step 641). Since the coefficient value β varies according to an emergency stop factor, it is also good to adopt a method of preparing a table beforehand. Next, the summing processing of the image data accumulation counter CNT is performed using the calculated coefficient value β ($CNT=CNT+\beta\times N$: step 642).

The above is the measuring method of the amount of waste toner at the time of occurrence of an emergency stop, and the forecast of the amount of waste toner using the measurement result.

Since it becomes possible to estimate the amount of waste toner accurately every occurrence factor at the time of emergency stop occurrence by using the control explained above, an accurate forecast of the amount of waste toner becomes possible. When an apparatus is superannuated, or even when an occurrence frequency of emergency stops sharply varies according to recording media which a user uses, or environments, an accurate forecast of the amount of waste toner is possible. Furthermore, in this embodiment, although sheet empty and JAM are cited and explained as examples as factors of occurrence of emergency stops, the present invention is not limited to this and can be implemented by preparing the coefficient value β as a table according to factors of emergency stops, such as cover opening during image formation.

Embodiment 3

Next, the above-described control (4) will be explained.

There is apparatus adjustment control that a toner image whose image data cannot be measured is applied on an image bearing member. As an example, when forming the low DUTY of image continuously, the capacity of a cleaning apparatus may drop. In such a case, capacity restoration control of the cleaning apparatus may be performed by counting the number of continuous image formation of low DUTY of images, and applying toner on an image bearing member by the predetermined number of images. At that time, the toner image applied on then image bearing member is formed using the potential difference between a developing apparatus and the photosensitive member. Therefore, it is not possible to measure image data by the above-described image data measuring means. In addition, in the adjustment control using a pattern image explained in Embodiment 1, image data may not be measured depending on an apparatus.

In such adjustment control that image data cannot be measured, it is possible to implement the forecast control of the amount of waste toner which the present invention proposes by preparing as a table the amount of waste toner, generated in each control, beforehand.

It is possible to use a waste toner vessel efficiently without flooding the waste toner vessel since it becomes possible to measure the amount of waste toner further in detail by using the controls explained above.

Furthermore, this embodiment uses the method of performing detection with the amount of the electrostatic latent images formed on the image bearing member with the semiconductor laser, that is, the number of image data counted by the image forming portion 200, as means of detecting the toner amount formed in the image bearing member. Nevertheless, the present invention is not limited to this, and it goes without saying that other methods may be used so long as the toner amount formed on an image bearing member is detectable.

Moreover, the structure of using a photosensitive member and intermediate transferring material is explained in this embodiment. Nevertheless, the present invention is not limited to the above-mentioned structure of an apparatus, and has the structure of being widely implemented without being limited in the number of colors for image formation so long as it is an image forming apparatus with the structure of having a sensor which performs the near-end detection of a waste toner vessel.

The structure using a photosensitive member and intermediate transferring material is explained in the above embodiments. Nevertheless, the present invention is not limited to the above-mentioned structure of an apparatus, and can be widely implemented without being limited in the number of colors for image formation so long as it is an image forming apparatus with the structure of having a sensor which performs the near-end detection of a waste toner vessel.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-098623 filed Mar. 30, 2004, which is hereby incorporated by reference herein.

What is claimed is:

1. An image forming apparatus comprising:

an image bearing member;

a toner image forming unit for forming a toner image on said image bearing member;

a transfer unit for transferring the toner image formed on said image bearing member onto a recording material;

adjusting means for adjusting a condition of said toner image forming means based on a detection of an adjustment toner image formed on said image bearing member and not formed on a recording material;

a cleaning member for cleaning toner on said image bearing member;

a container for containing the cleaned toner;

a detecting device for detecting that an amount of toner in said container has reached a predetermined amount; and a processing portion that counts an amount of data relating to images formed on said image bearing member and calculates an accumulation count value, wherein the accumulation count value is obtained by accumulating a value corresponding to an amount of data relating to images formed on a recording material after the amount of toner in said container has reached the predetermined amount, a value multiplied an amount of data relating to the adjacent toner images formed after the amount of toner in said container has reached the predetermined amount by a first coefficient, and a value multiplied an amount of data relating to a toner image which is not formed on a recording material by an abnormal condition after the amount of toner in said container has reached the predetermined amount by a second coefficient not equal to the first coefficient, and wherein when the accumulation count value calculated by said processing portion exceeds a preset value, said processing portion prohibits image formation.

2. An image forming apparatus according to claim 1, further comprising a belt member on which the image formed on said image bearing member is transferred; and a second cleaning member that cleans toner on said belt member, wherein the toner cleaned by said cleaning member is contained in said container.

3. An image forming apparatus according to claim 1, wherein the second coefficient is a variable in accordance with a type of abnormal operating condition of the apparatus.

* * * * *